US008888212B2

(12) United States Patent
MacKenzie et al.

(10) Patent No.: US 8,888,212 B2
(45) Date of Patent: Nov. 18, 2014

(54) PRINTHEAD SPACING

(71) Applicant: Hewlett-Packard Development Company, L.P., Houston, TX (US)

(72) Inventors: Mark H. MacKenzie, Vancouver, WA (US); Wesley R. Schalk, Vancouver, WA (US); Paul Coffin, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/752,962

(22) Filed: Jan. 29, 2013

(65) Prior Publication Data

US 2014/0210882 A1 Jul. 31, 2014

(51) Int. Cl.
*B41J 25/308* (2006.01)

(52) U.S. Cl.
CPC ..... *B41J 25/308* (2013.01)
USPC ..... 347/8

(58) Field of Classification Search
USPC ..... 347/4, 5, 8, 14–18
See application file for complete search history.

(56) References Cited

U.S. PATENT DOCUMENTS

| | | | | |
|---|---|---|---|---|
| 4,676,675 | A | 6/1987 | Suzuki et al. | |
| 4,917,512 | A | 4/1990 | Mimura et al. | |
| 4,990,004 | A | 2/1991 | Kawahara et al. | |
| 5,468,076 | A | 11/1995 | Hirano et al. | |
| 5,746,526 | A | 5/1998 | Hirose | |
| 5,838,338 | A | 11/1998 | Olson | |
| 6,102,509 | A | 8/2000 | Olson | |
| 6,386,663 | B1 * | 5/2002 | Olson | 347/8 |
| 6,416,146 | B1 | 7/2002 | Chua et al. | |
| 6,705,717 | B1 * | 3/2004 | Fujita et al. | 347/106 |
| 8,282,185 | B2 | 10/2012 | Silverbrook | |
| 2007/0048057 | A1 | 3/2007 | Youn et al. | |
| 2008/0136851 | A1 * | 6/2008 | Masuyama et al. | 347/8 |
| 2009/0015610 | A1 * | 1/2009 | Nagamura et al. | 347/9 |
| 2010/0156977 | A1 * | 6/2010 | Kanematsu et al. | 347/14 |
| 2011/0199412 | A1 * | 8/2011 | Nakayama | 347/14 |
| 2012/0086747 | A1 * | 4/2012 | Terada | 347/9 |
| 2012/0320128 | A1 | 12/2012 | Kumazaki | |

FOREIGN PATENT DOCUMENTS

JP 2004098412 A * 4/2004 ..... B41J 2/01

* cited by examiner

*Primary Examiner* — Hai C Pham

(57) ABSTRACT

A method of printing includes directing print media to a print zone between a printhead and a platen for a print job; and adjusting a spacing between the printhead and the platen during the print job, including one of adjusting the spacing within a page of the print job and adjusting the spacing between pages of the print job.

18 Claims, 11 Drawing Sheets

PRINTHEAD SPACING

BACKGROUND

An inkjet printing system may include a printhead which ejects drops of ink through a plurality of nozzles or orifices and toward print media, such as a sheet of paper, so as to print on the print media. Typically, the orifices are arranged such that properly sequenced ejection of ink from the orifices causes characters or other images to be printed upon the print media as the printhead and the print media are moved relative to each other. Improper spacing between the printhead and the print media (too close or too far) may contribute to media damage, print jams, and poor print quality.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
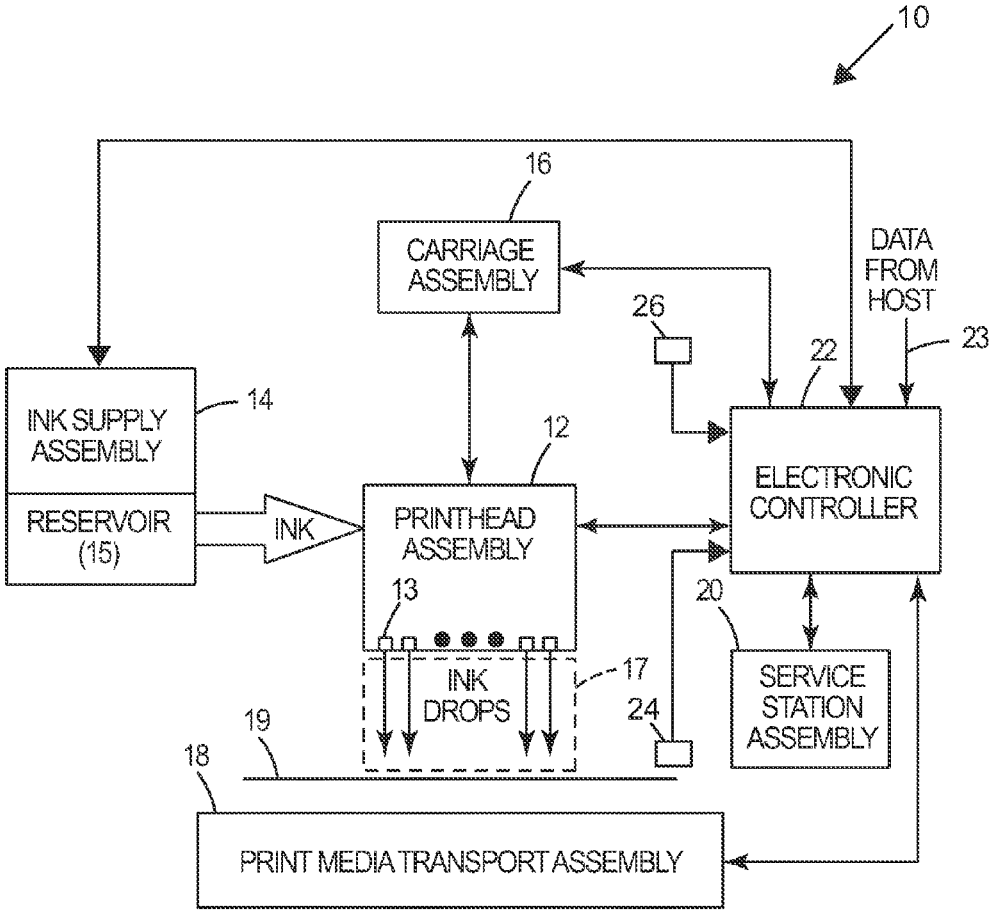
FIG. 1 is a block diagram illustrating one example of an inkjet printing system.

FIG. 1 illustrates one example of an inkjet printing system 10. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a print media transport assembly 18, a service station assembly 20, and an electronic controller 22.

Printhead assembly 12 includes one or more printheads or fluid ejection devices which eject drops of ink or fluid through a plurality of orifices or nozzles 13. In one example, the drops are directed toward a medium, such as print media 19, so as to print onto print media 19. Print media 19 includes any type of suitable sheet material, such as paper, card stock, transparencies, Mylar, fabric, and the like. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen. In another example, ink supply assembly 14 is separate from printhead assembly 12 and supplies ink to printhead assembly 12 through an interface connection, such as a supply tube.

Carriage assembly 16 positions printhead assembly 12 relative to print media transport assembly 18 and print media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to print media transport assembly 18. In another example, printhead assembly 12 is a non-scanning type printhead assembly such that carriage assembly 16 fixes printhead assembly 12 at a prescribed position relative to print media transport assembly 18.

Service station assembly 20 provides for spitting, wiping, capping, and/or priming of printhead assembly 12 in order to maintain a functionality of printhead assembly 12 and, more specifically, nozzles 13. For example, service station assembly 20 may include a rubber blade or wiper which is periodically passed over printhead assembly 12 to wipe and clean nozzles 13 of excess ink. In addition, service station assembly 20 may include a cap which covers printhead assembly 12 to protect nozzles 13 from drying out during periods of non-use. In addition, service station assembly 20 may include a spittoon into which printhead assembly 12 ejects ink to insure that reservoir 15 maintains an appropriate level of pressure and fluidity, and insure that nozzles 13 do not clog or weep. Functions of service station assembly 20 may include relative motion between service station assembly 20 and printhead assembly 12.

Electronic controller 22 communicates with printhead assembly 12, carriage assembly 16, print media transport assembly 18, and service station assembly 20. Thus, in one example, when printhead assembly 12 is mounted in carriage assembly 16, electronic controller 22 and printhead assembly 12 communicate via carriage assembly 16. Electronic controller 22 also communicates with ink supply assembly 14 such that, in one implementation, a new (or used) ink supply may be detected, and a level of ink in the ink supply may be detected.

Electronic controller 22 receives data 23 from a host system, such as a computer, and may include memory for temporarily storing data 23. Data 23 may be sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one example, electronic controller 22 provides control of printhead assembly 12 including timing control for ejection of ink drops from nozzles 13. As such, electronic controller 22 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 22 is located on printhead assembly 12. In another example, logic and drive circuitry forming a portion of electronic controller 22 is located off printhead assembly 12.

In one example, inkjet printing system 10 includes a media sensor 24 to sense parameters or characteristics of print media 19, such as a type of print media 19 and/or a weight of print media 19, and includes an environmental sensor 26 to sense ambient conditions of inkjet printing system 10, such as a temperature and/or a humidity of inkjet printing system 10, including where and/or when inkjet printing system 10 is operating. In one implementation, media sensor 24 and/or environmental sensor 26 provide input to determine and/or control a spacing between a printhead and a platen of inkjet printing system 10, as described below.

Figure 2:
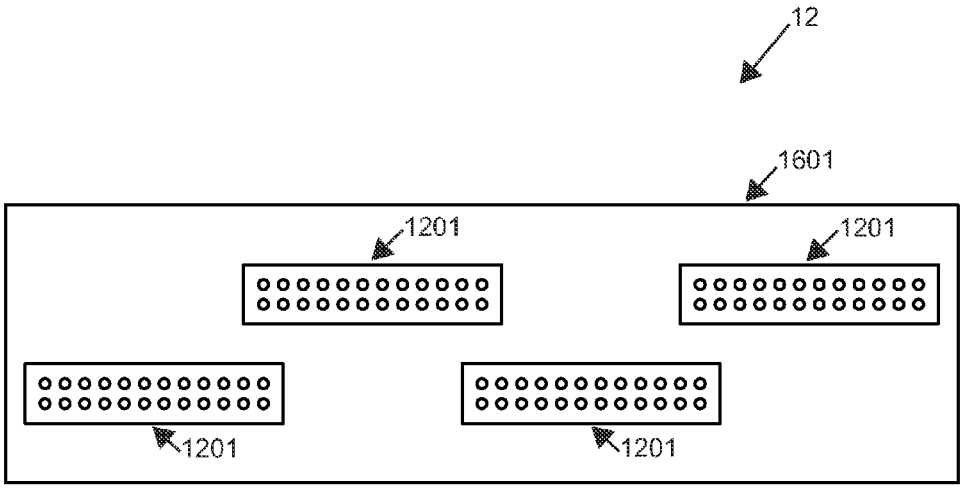
FIG. 2 is a schematic illustration of one example of a printhead assembly of an inkjet printing system.

In one example, as illustrated in FIG. 2, printhead assembly 12 is a wide-array or multi-head printhead assembly and includes a carrier 1601, as an example of carriage assembly 16, and a plurality of printhead dies 1201 mounted on carrier 1601. In one implementation, printhead dies 1201 are arranged and aligned in one or more overlapping rows (as oriented in FIG. 2) such that printhead dies 1201 in one row overlap at least one printhead die 1201 in another row. As such, printhead assembly 12 may span a nominal page width or a width shorter or longer than a nominal page width. For example, printhead assembly 12 may span 8.5 inches of a Letter size print medium or a distance greater than or less than 8.5 inches of the Letter size print medium. While four printhead dies 1201 are illustrated as being mounted on carrier 1601, the number of printhead dies 1201 mounted on carrier 1601 may vary.

In one implementation, printhead assembly 12, as a wide-array or multi-head printhead assembly including printhead dies 1201, is a non-scanning type printhead assembly such that carrier 1601 fixes printhead assembly 12 at a prescribed position relative to print media transport assembly 18 (FIG. 1). With a position of printhead assembly 12 fixed, print media 19 (FIG. 1) is moved or advanced relative to printhead assembly 12 during printing.

Figure 3:
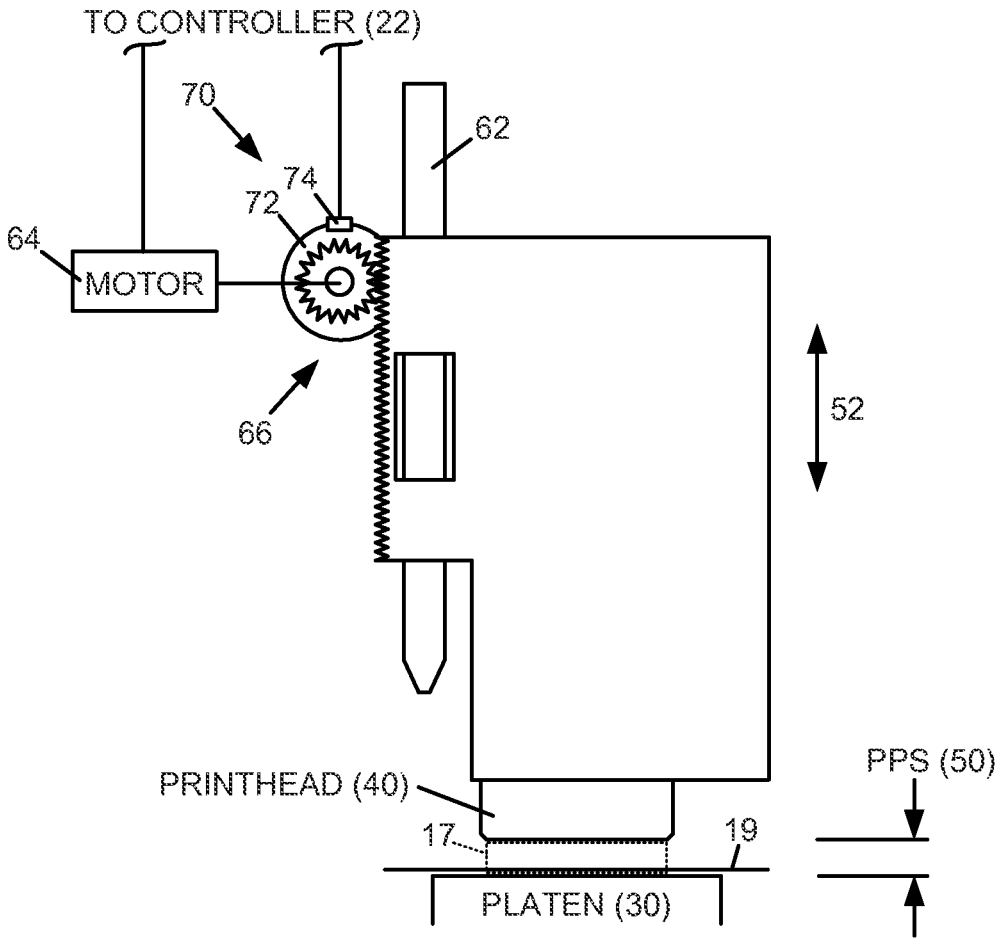
FIG. 3 is a schematic illustration of one example of adjusting printhead spacing in an inkjet printing system.

FIG. 3 is a schematic illustration of one example of adjusting printhead spacing in an inkjet printing system, such as inkjet printing system 10 (FIG. 1). More specifically, FIG. 3 is a schematic illustration of one example of adjusting a spacing between a printhead 40, as an example of printhead assembly 12 (FIG. 1), and a platen 30 supporting print media 19. More specifically, platen 30 is positioned opposite printhead 40 and supports print media 19 as print media is advanced through print zone 17 as defined between printhead 40 and platen 30. As such, a printhead-to-platen spacing (PPS) 50 is defined between printhead 40 and platen 30. Such spacing, also referred to as printhead-to-paper spacing and/or pen-to-paper spacing, is adjusted, as described below.

In one example, as schematically illustrated in FIG. 3, spacing 50 is adjusted by raising and lowering printhead 40 relative to platen 30. More specifically, in one example, printhead 40 is raised and lowered orthogonal (i.e., substantially perpendicular) to platen 30, as indicated by double arrow 52. In one implementation, printhead 40 is supported by or slidingly coupled with a linear guide 62, and raised and lowered along guide 62 by a motor 64 and a transmission arrangement 66 to adjust spacing 50 between printhead 40 and platen 30. In the illustrated example, transmission arrangement 66 includes a rack-and-pinion arrangement. In another example, transmission arrangement 66 may include a worm gear arrangement. Other arrangements, configurations, systems or assemblies for effectuating linear movement or translation of printhead 40 may also be used. In one example, an adjusted spacing of printhead 40 is held by motor 64 (and transmission arrangement 66), as described below.

In one implementation, an encoding system 70 is included to provide control of spacing 50. In the illustrated example of FIG. 3, encoding system 70 includes a rotary encoder 72 and an associated reader 74. In another example, encoding system 70 may include a linear encoder and an associated reader. In one example, encoding system 70 including, more specifically, reader 74, is communicated with electronic controller 22 (FIG. 1) to provide positional information of encoder 72 and, therefore, information (or input) as to a position of printhead 40. As such, the position of printhead 40 may be correlated with spacing 50 of printhead 40, as described below. In addition, in one example, motor 64 is communicated with electronic controller 22 (FIG. 1) such that, based on information (or input) from media sensor 24, environmental sensor 26, and/or other information of inkjet printing system 10, spacing 50 of printhead 40 may be adjusted, as described below.

In one example, information of inkjet printing system 10 forming a basis for adjustment of spacing 50 of printhead 40 may include information or selections input or set by a user (for example, through a printer control panel or through a printer driver), and may be included in data 23 received by electronic controller 22 (FIG. 1). For example, a user may set a media type and/or select a media orientation, as described below, through a printer control panel or a printer driver.

In one implementation, spacing 50 of printhead 40 is adjusted "on-the-fly" and may be adjusted at anytime, as described below. In addition, spacing 50 of printhead 40 may be adjusted with incremental advancements and adjusted to indiscrete (or infinite) settings.

Figure 4A:
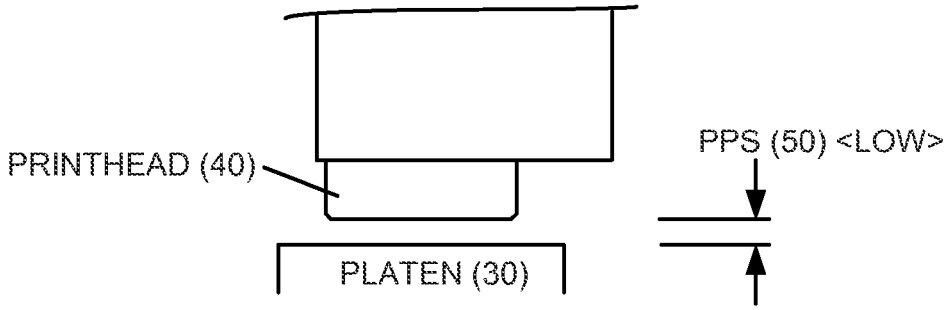
FIGS. 4A, 4B, and 4C illustrate different examples of printhead spacing in an inkjet printing system.
Figure 4B:
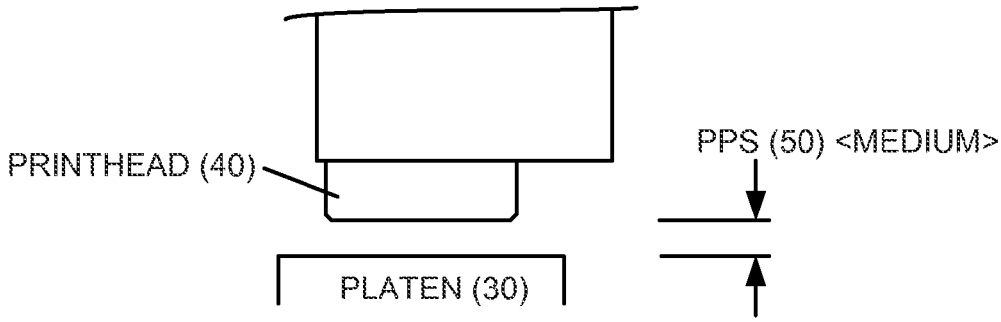
Figure 4C:
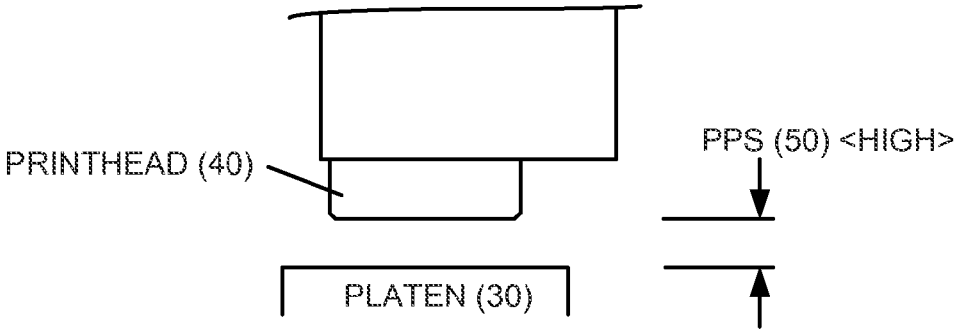

FIGS. 4A, 4B, and 4C illustrate different examples of printhead spacing, such as different examples of spacing 50 of printhead 40. More specifically, FIG. 4A illustrates one example of a "Low" spacing of printhead 40, FIG. 4B illustrates one example of a "Medium" spacing of printhead 40, and FIG. 4C illustrates one example of a "High" spacing of printhead 40. It is understood that the illustrated spacings of printhead 40 have been exaggerated for illustrative purposes.

In one example, the "Low" spacing of printhead 40, the "Medium" spacing of printhead 40, and the "High" spacing of printhead 40 are implemented in a printing system, such as inkjet printing system 10, during a print job (for example, during processing, execution, or performance of a print job), as described below. In addition, the "Low" spacing of printhead 40, the "Medium" spacing of printhead 40, and the "High" spacing of printhead 40 are implemented in a printing system, such as inkjet printing system 10, based on a condition (or conditions) of printing and/or a characteristic (or characteristics) of print media, such as print media 19, as described below.

Figure 5:
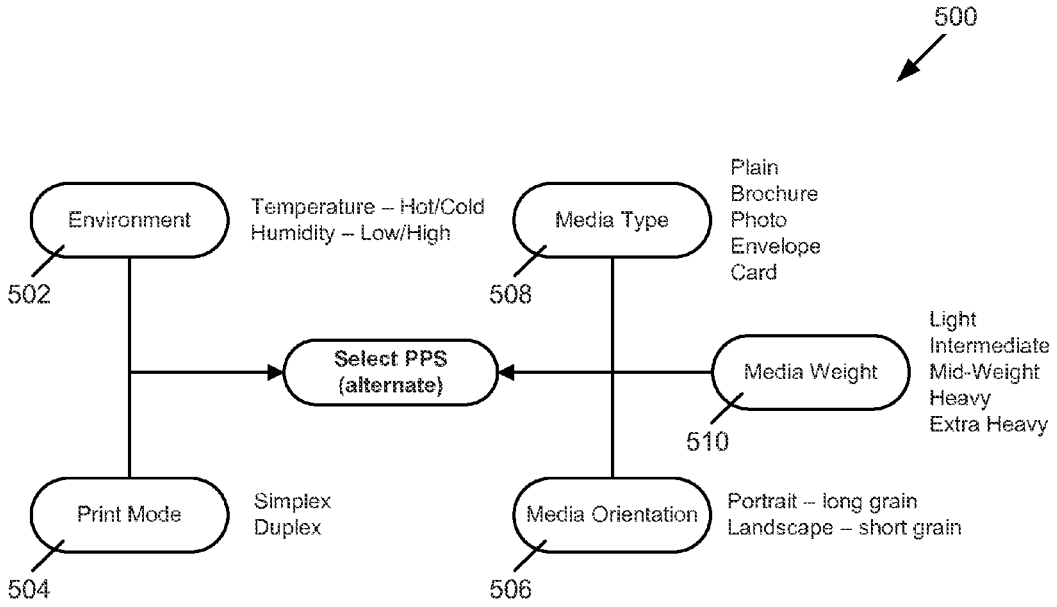
FIG. 5 is a schematic illustration of one example of selecting printhead spacing in an inkjet printing system.

FIG. 5 is a schematic illustration of one example of a selection 500 of printhead spacing, such as a selection of spacing 50 of printhead 40. More specifically, in one example, spacing 50 of printhead 40 is selected based on a condition (or conditions) of printing, including before or during printing, and/or a characteristic (or characteristics) of print media, such as print media 19. A condition of printing includes, for example, an environment 502 of the printing, a print mode 504 of the printing, and/or a media orientation 506 of the printing. In addition, a characteristic of print media 19 includes, for example, a media type 508 and/or a media weight 510.

Environment 502 of the printing includes, for example, temperature and/or humidity, as measured, for example, by environmental sensor 26. In one example, environment 502 considers whether an ambient temperature is "hot" or "cold", and considers whether an ambient humidity is "low" or "high". As such, spacing 50 of printhead 40 may be selected (and set) based on environmental conditions, as described below.

Print mode 504 of the printing includes, for example, a "Simplex" print mode (single-sided printing) or a "Duplex" print mode (two-sided printing) as defined or selected for the printing. In one example, printing with a "Simplex" print mode and printing with a "Duplex" print mode may include different spacings 50 of printhead 40, as described below. More specifically, printing on different sides of a single sheet of print media 19 during a "Duplex" print mode may include different spacings 50 of printhead 40 for each side of the single sheet of print media 19, as described below.

Media orientation 506 of the printing includes, for example, a "Portrait" orientation of print media 19 or a "Landscape" orientation of print media 19 as specified or selected for the printing. In one example, printing with a "Portrait" orientation and printing with a "Landscape" orientation may include different spacings 50 of printhead 40, as described below. In one implementation, a "Portrait" orientation of print media 19 includes advancing print media 19 through inkjet printing system 10, including through print zone 17, in a direction parallel with a longer dimension of print media 19 and substantially parallel with a grain of print media 19 ("long grain"), and a "Landscape" orientation of print media 19 includes advancing print media 19 through inkjet printing system 10, including through print zone 17, in a direction perpendicular to a longer dimension of print media 19 and substantially perpendicular to a grain of print media 19 ("short grain").

Media type 508 includes, for example, a type of print media 19. For example, different types of print media 19 may include different spacings 50 of printhead 40, as described below. In one example, the different types of print media 19 may include "Plain" paper, "Brochure", "Photo" paper, "Envelope", and "Card". The type of print media 19, however, may also include other types of print media.

Media weight 510 includes, for example, a weight of print media 19. For example, different weights of print media 19 may include different spacings 50 of printhead 40, as described below. In one example, the different weights of print media 19 may include "Light", "Intermediate", "Mid-Weight", "Heavy", and "Extra Heavy".

Figure 6:
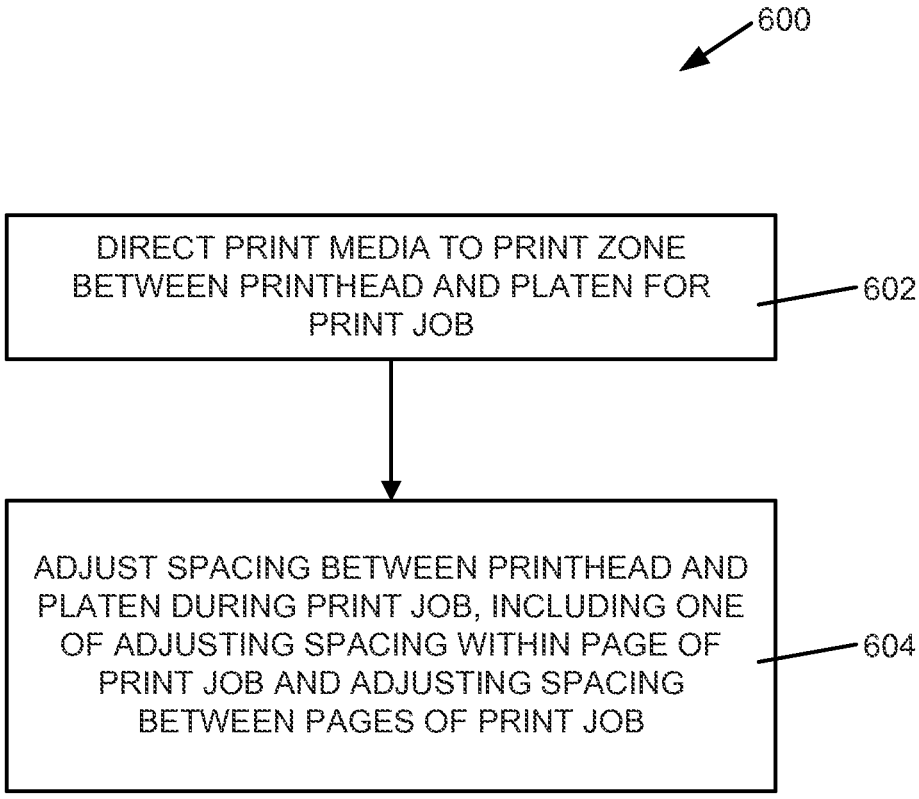
FIG. 6 is a flow diagram illustrating one example of a method of printing.

FIG. 6 is a flow diagram illustrating one example of a method 600 of printing. With method 600, at 602, print media, such as print media 19, is directed to a print zone between a printhead and a platen for a print job, such as print zone 17 between printhead 40 and platen 30, as schematically illustrated, for example, in FIG. 3.

At 604, a spacing between the printhead and the platen is adjusted during the printing, such as spacing 50 between printhead 40 and platen 30, as schematically illustrated, for example, in FIGS. 4A, 4B, and 4C. In one implementation, the spacing between the printhead and the platen is adjusted within a page of the print job. More specifically, one spacing of the printhead may be established for an end portion of the print media, and another spacing of the printhead may be established for an intermediate portion of the print media.

For example, a "High" spacing of the printhead may be established for a leading end of the print media (for example, as the print media is fed or advanced into the print zone), and a "Low" spacing of the printhead may be established for an intermediate portion of the print media (for example, once the leading end of the print media is through the print zone). In addition, a "High" spacing of the printhead may be established for a trailing end of the print media (for example, as the print media is exiting the print zone). As such, page curl or "cockle" of the leading end and/or the trailing end of the print media, which may result in jam problems, may be accounted for or compensated for by increasing the spacing (i.e., raising the printhead) for the leading end and/or the trailing end of the print media. In addition, acceptable or suitable print quality may be obtained by decreasing the spacing (i.e., lowering the printhead) for the intermediate portion of the print media (for example, as printing occurs in the intermediate portion of the print media).

In another implementation, the spacing between the printhead and the platen is adjusted between pages of the print job. More specifically, the spacing of the printhead may be adjusted between subsequent pages or consecutive pages of a single print job. For example, a first spacing of the printhead may be established for a first page of a print job and a second spacing of the printhead may be established for a second page of the same print job.

In one example, the first and second pages of a print job include different types of print media. For example, a "mixed media" print job may include different types of print media for different pages of the same print job (for example, "Envelope" for page 1 and "Plain Paper" for page 2). As such, different spacings of the printhead may be established for the different pages of the same print job (for example, "High" spacing for the "Envelope" as page 1 and "Low" spacing for the "Plain Paper" as page 2).

In another example, the first and second pages of a print job include opposite sides of one sheet of print media (i.e., a single sheet of print media). For example, a duplex print job includes printing on both sides of one sheet of print media (double-sided printing). As such, a first spacing of the printhead may be established for a first side of the one sheet of print media (as a first page of the print job), and a second spacing of the printhead may be established for a second side of the one sheet of print media (as a second page of the print job). For example, a "Low" spacing of the printhead may be established for the first side of the one sheet of print media, and a "Medium" spacing of the printhead may be established for the second side of the one sheet of print media. As such, page curl or "cockle" of the sheet, which may occur after printing on the first side of the sheet and may result in smearing and/or jam problems, may be accounted for or compensated for when the sheet is fed or advanced back to the print zone for printing on the second side of the sheet.

Figure 7A:
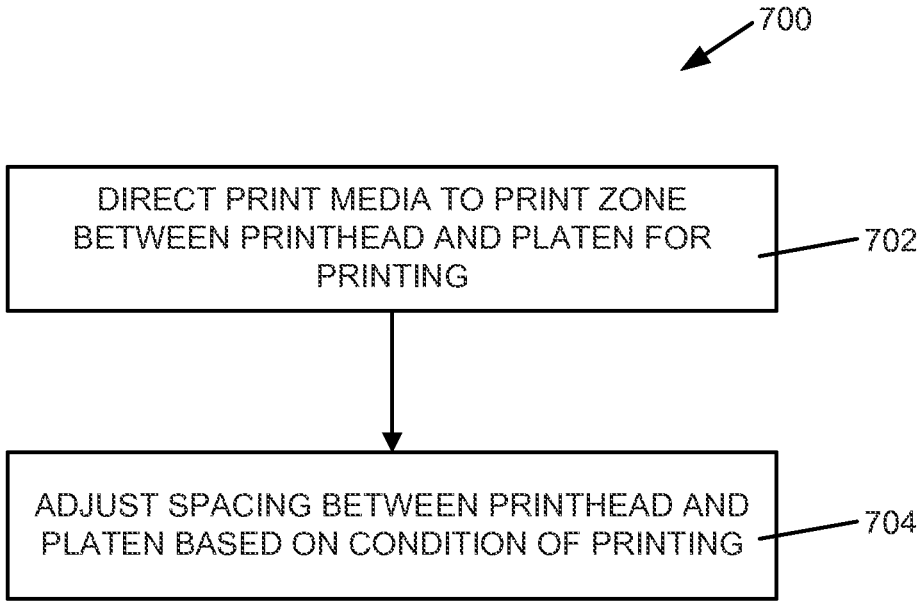
FIGS. 7A and 7B are flow diagrams illustrating one example of a method of printing.
Figure 7B:
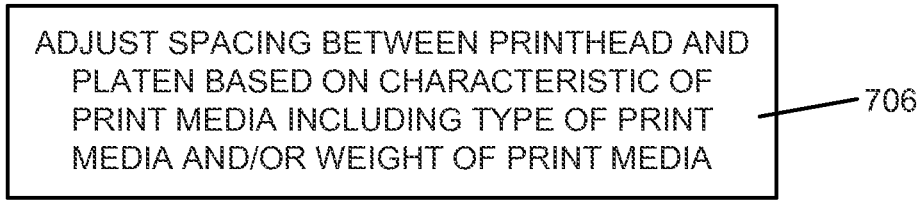

FIGS. 7A and 7B are flow diagrams illustrating one example of a method 700 of printing. With method 700, at 702, print media, such as print media 19, is directed to a print zone between a printhead and a platen for printing, such as print zone 17 between printhead 40 and platen 30, as schematically illustrated, for example, in FIG. 3.

At 704, a spacing between the printhead and the platen is adjusted, such as spacing 50 between printhead 40 and platen 30, as schematically illustrated, for example, in FIGS. 4A, 4B, and 4C. In one implementation, the spacing between the printhead and the platen is adjusted based on a condition of the printing. A condition of the printing may include, for example, an environment of the printing, such as environment 502, a print mode of the printing, such as print mode 504, and/or a media orientation of the printing, such as media orientation 506, as schematically illustrated, for example, in FIG. 5. As such, different spacings of the printhead may be established for different conditions of the printing, such as different selected or designated options for the printing, as described below.

At 706, a spacing between the printhead and the platen is adjusted, such as spacing 50 between printhead 40 and platen 30, as schematically illustrated, for example, in FIGS. 4A, 4B, and 4C. In one implementation, the spacing between the printhead and the platen is adjusted based on a characteristic of the print media. A characteristic of the print media may include, for example, a type of print media, such as media type 508, and/or a weight of print media, such as media weight 510, as schematically illustrated, for example, in FIG. 5. As such, different spacings of the printhead may be established for different media types and/or different media weights, as described below.

Although method 600 and method 700 are illustrated and described as separate methods of printing, it is understood that method 600 (partially or fully) and method 700 (partially or fully) may be included or combined (partially or fully) in a method of printing. In addition, an order or sequence of method 600 and/or method 700 may be varied.

Figure 8:
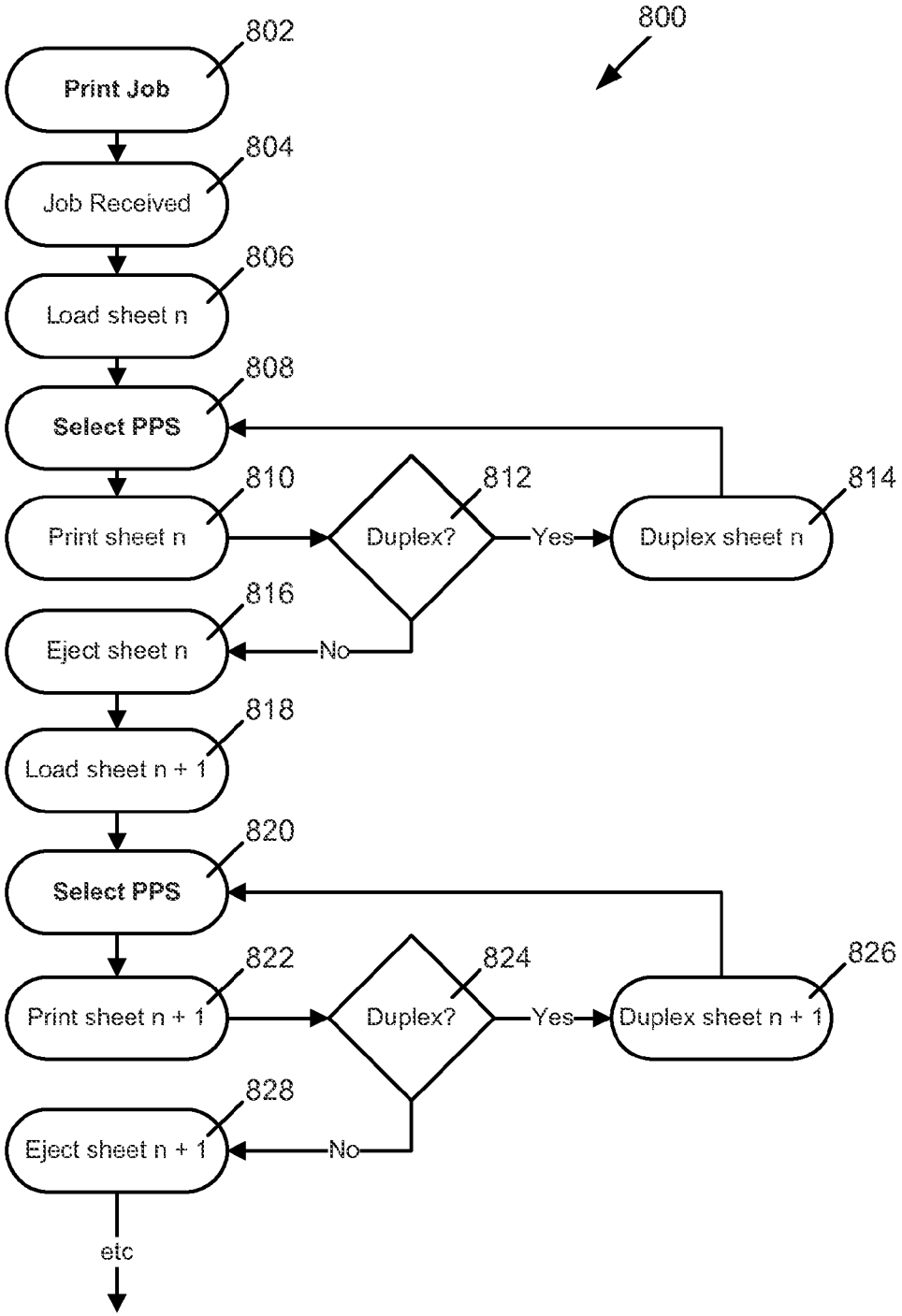
FIG. 8 is a flow diagram illustrating one example of implementing a method of printing.

FIG. 8 is a flow diagram illustrating one example of an implementation 800 of a method of printing. More specifically, implementation 800 illustrates one example of implementing method 600 and/or method 700.

With implementation 800, at 802, a print job is initiated. At 804, the print job is received by a printing system, such as inkjet printing system 10, and at 806, sheet n of the print job is loaded in the printing system. At 808, a PPS is selected for sheet n. More specifically, a printhead spacing, such as spacing 50 of printhead 40, is selected for sheet n. The PPS may be selected, as further described herein. At 810, sheet n is printed with the selected PPS.

At 812, a determination is made as to whether sheet n is a duplex sheet. More specifically, a determination is made as to whether sheet n is to receive double-sided printing. If sheet n is to receive double-sided printing, at 814, sheet n is determined to be a duplex sheet. As such, at 808, a PPS is selected for the duplex side of sheet n, and at 810, the duplex side of sheet n is printed with the selected PPS. More specifically, a printhead spacing, such as spacing 50 of printhead 40, is selected for printing the second side (for example, back-side) of sheet n, and the second side of sheet n is printed with the selected spacing. For example, the PPS of the duplex side of sheet n (for example, second side) may be greater than the PPS of the simplex side of sheet n (for example, first side) to account for or compensate for possible curl or "cockle" of sheet n after the simplex side of sheet n has been printed. Printing of a duplex print job, however, may also include printing of both sides of the sheet (for example, first side and second side of sheet n) with the greater PPS to provide similar print quality on both sides of the sheet since printing with different printhead spacings for different sides of the sheet may result in different print qualities on the different sides.

Returning to 812, if sheet n is not a duplex sheet (or sheet n has already been printed as a duplex sheet and is not to receive additional printing), at 816, sheet n is ejected.

At 818, sheet n+1 of the print job is loaded in the printing system. More specifically, the next sheet (if any) of the print job is loaded in the printing system. As such, at 820, 822, 824, 826, and 828, the above-described sequence of selecting a PPS and printing with the selected PPS, determining a duplex printing, selecting a PPS and printing with the selected PPS if duplex printing is determined, and ejecting the printed sheet, is repeated. In one example, such sequence is repeated for each sheet of the print job. Thus, with implementation 800, printhead spacing is adjusted between pages of the print job (for example, side one, side two of a duplex sheet) (for example, sheet n, sheet n+1).

Figure 9:
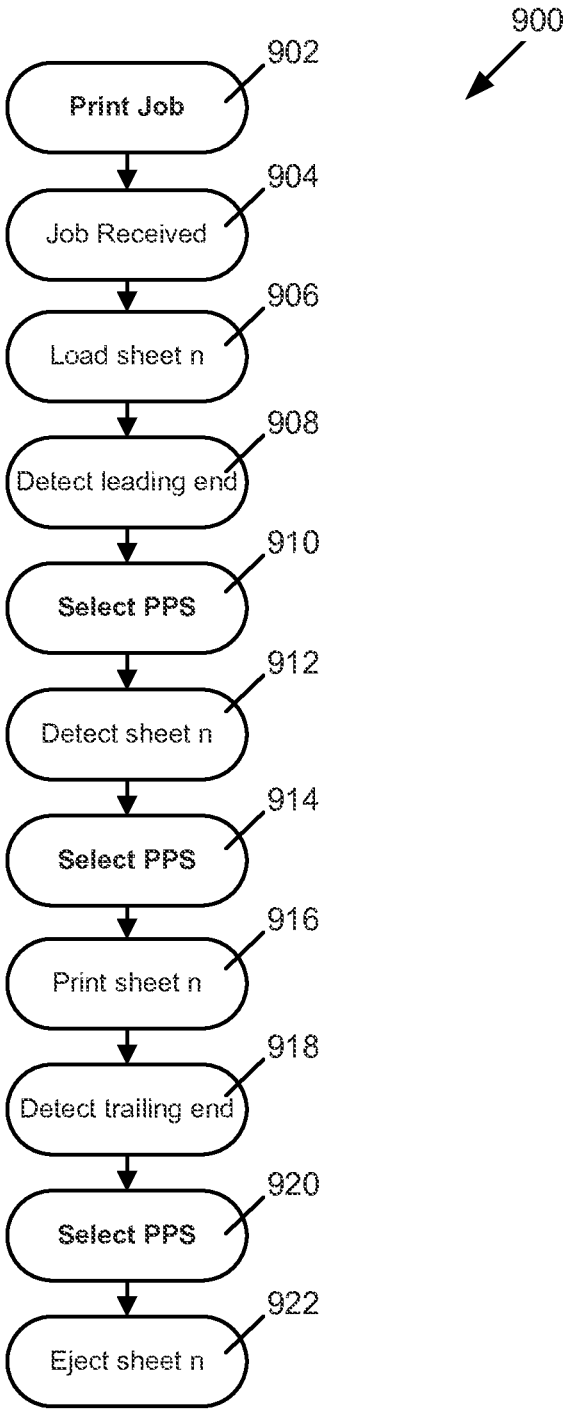
FIG. 9 is a flow diagram illustrating one example of implementing a method of printing.

FIG. 9 is a flow diagram illustrating one example of an implementation 900 of a method of printing. More specifically, implementation 900 illustrates one example of implementing method 600 and/or method 700.

With implementation 900, at 902, a print job is initiated. At 904, the print job is received by a printing system, such as inkjet printing system 10, and at 906, sheet n of the print job is loaded in the printing system.

At 908, a leading end (or portion) of sheet n is detected. In one example, the leading end (or portion) of sheet n is detected before sheet n enters the print zone. The leading end (or portion) of sheet n may be detected, for example, by media sensor 24 (FIG. 1).

At 910, a PPS is selected for the leading end (or portion) of sheet n. More specifically, a printhead spacing, such as spacing 50 of printhead 40, is selected for the leading end (or portion) of sheet n. The PPS may be selected, as further described herein.

At 912, sheet n is detected. More specifically, an intermediate portion of sheet n (i.e., non-leading end portion, non-trailing end portion) is detected, and at 914, a PPS is selected for sheet n. More specifically, a printhead spacing, such as spacing 50 of printhead 40, is selected for the intermediate portion of sheet n. The PPS may be selected, as further described herein.

At 916, sheet n is printed with the selected PPS. More specifically, sheet n is printed with the PPS selected for the intermediate portion of sheet n.

At 918, a trailing end (or portion) of sheet n is detected. In one example, the trailing end (or portion) of sheet n is detected before sheet n exits the print zone. The trailing end (or portion) of sheet n may be detected, for example, by media sensor 24 (FIG. 1).

At 920, a PPS is selected for the trailing end (or portion) of sheet n. More specifically, a printhead spacing, such as spacing 50 of printhead 40, is selected for the trailing end (or portion) of sheet n. The PPS may be selected, as further described herein.

At 922, sheet n is ejected. More specifically, sheet n is ejected with the PPS selected for the trailing end (or portion) of sheet n. Thus, with implementation 900, printhead spacing is adjusted within a page of the print job (for example, leading end, intermediate portion, trailing end).

Figure 10:
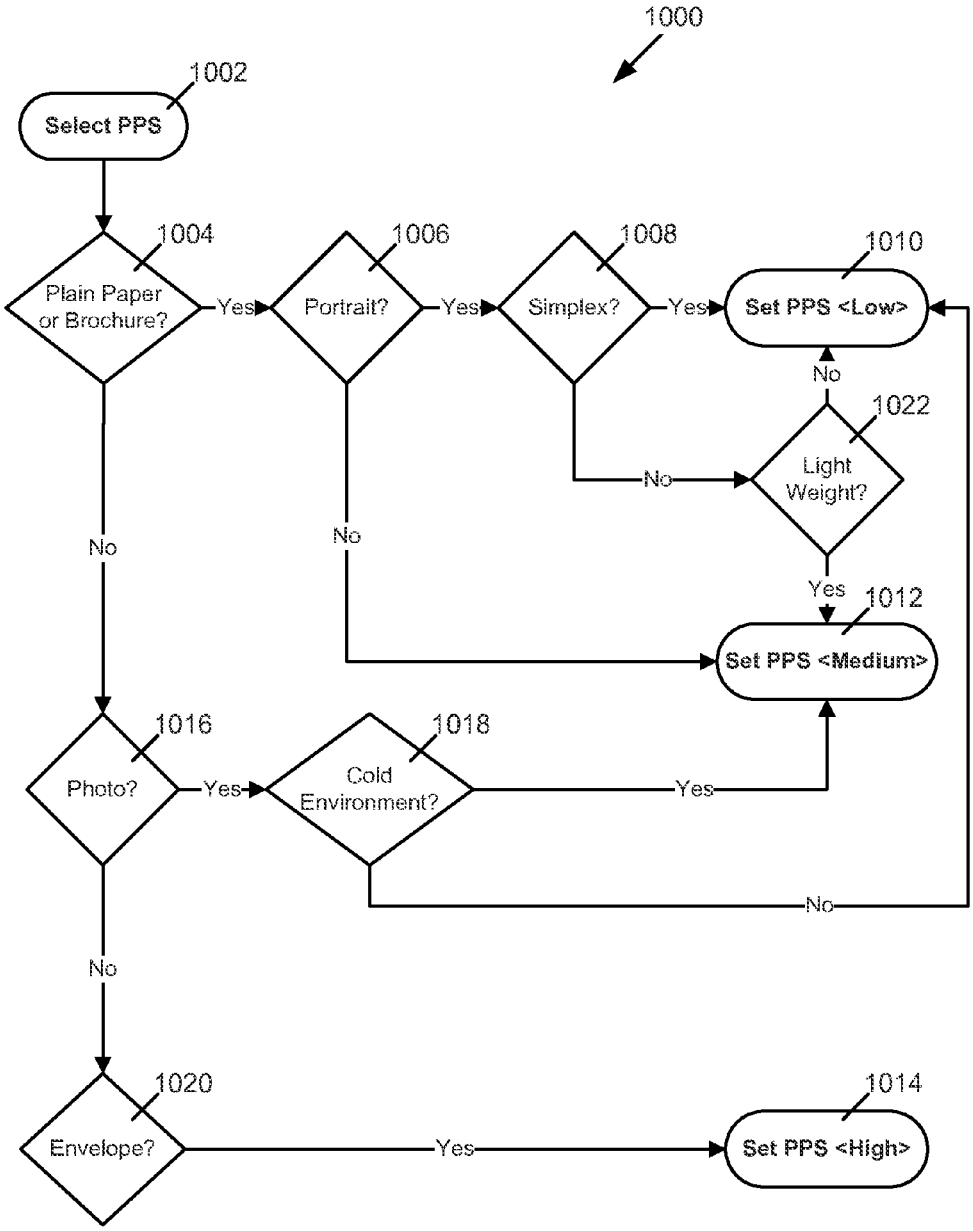
FIG. 10 is a flow diagram illustrating one example of implementing a method of printing.

FIG. 10 is a flow diagram illustrating one example of an implementation 1000 of a method of printing. More specifically, implementation 1000 illustrates one example of implementing method 600 and/or method 700.

With implementation 1000, at 1002, a PPS selection is initiated. More specifically, selection of a printhead spacing, such as spacing 50 of printhead 40, is initiated. At 1004, a determination is made as to whether the print media to be printed on is "Plain Paper or Brochure". If the print media to be printed on is "Plain Paper or Brochure", at 1006, a determination is made as to whether an orientation of the print media is "Portrait". If the orientation of the print media is "Portrait", at 1008, a determination is made as to whether a "Simplex" sheet is to be printed (for example, single-sided printing or side one of two-sided printing). If a "Simplex" sheet is to be printed, at 1010, a "Low" PPS is set.

Returning to 1008, if a "Simplex" sheet is not to be printed (for example, a "Duplex" sheet (i.e., side two of two-sided printing) is to be printed), at 1022, a determination is made as to whether the print media to be printed on is "Light Weight". If the print media to be printed on is "Light Weight", at 1012, a "Medium" PPS is set.

Returning to 1022, if the print media to be printed on is not "Light Weight", at 1010, a "Low" PPS is set.

Returning to 1006, if an orientation of the print media is not "Portrait" (for example, an orientation of the print media is "Landscape"), at 1012, a "Medium" PPS is set.

Returning to 1004, if the print media to be printed on is not "Plain Paper or Brochure", at 1016, a determination is made as to whether the print media to be printed on is "Photo" paper. If the print media to be printed on is "Photo" paper, at 1018, a determination is made as to whether an environment of the printing is a "Cold Environment" (for example, low temperature, low humidity). If the environment of the printing is a "Cold Environment", at 1012, a "Medium" PPS is set. In one example, with a "Cold Environment" of the printing, the "Medium" PPS is selected to provide greater spacing between the printhead and the print media so as to avoid possible contact with a printed image since the cold environment may lead to longer drying time of the printed image.

Returning to 1018, if the environment of the printing is not a "Cold Environment", at 1010, a "Low" PPS is set.

Returning to 1016, if the print media to be printed on is not "Photo" paper, at 1020, a determination is made as to whether the print media to be printed on is an "Envelope". If the print media to be printed on is an "Envelope" (or another type of thick print media), at 1014, a "High" PPS is set. Thus, with implementation 1000, printhead spacing is adjusted based on a condition of the printing (for example, "Portrait", "Simplex", "Cold Environment"), and adjusted based on a characteristic of the print media (for example, "Plain Paper or Brochure", "Photo", "Envelope", "Light Weight").

Although implementation 800, implementation 900, and implementation 1000 are illustrated and described as separate implementations of a method of printing, it is understood that implementation 800 (partially or fully), implementation 900 (partially or fully), and/or implementation 1000 (partially or fully) may be included or combined (partially or fully) in an implementation of a method of printing. In addition, an order or sequence of implementation 800, implementation 900, and/or implementation 1000 may be varied.

Figure 11:
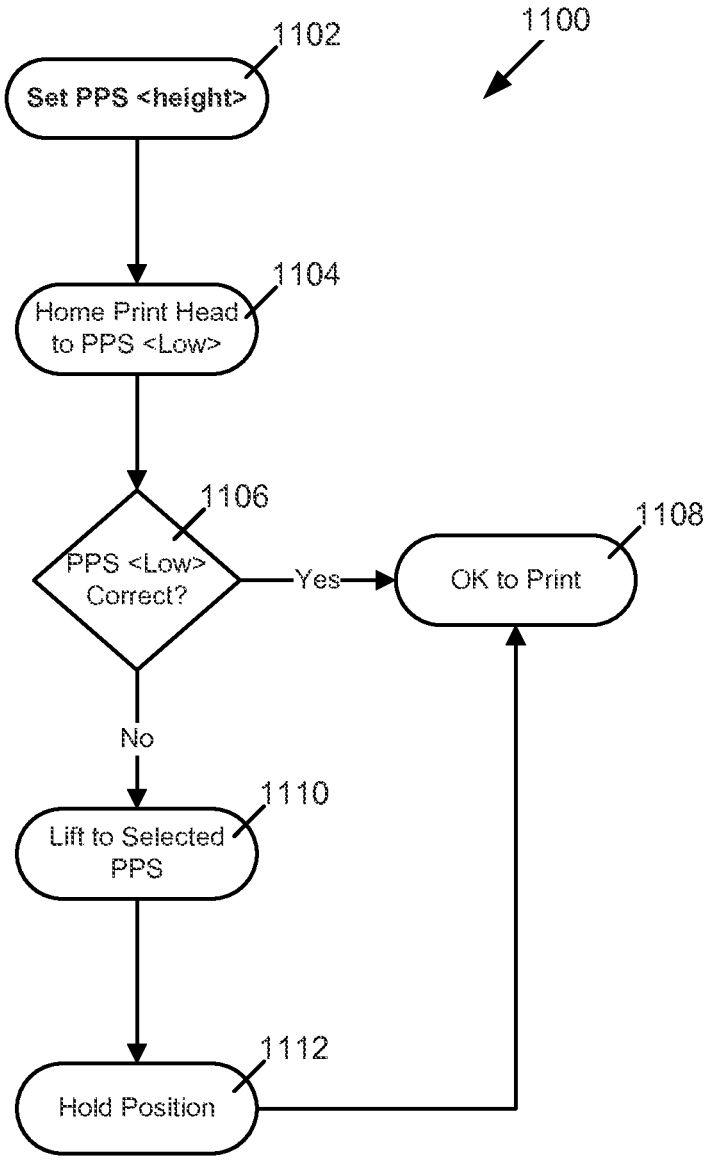
FIG. 11 is a flow diagram illustrating one example of setting a printhead spacing in an inkjet printing system.

FIG. 11 is a flow diagram illustrating one example of a sequence 1100 of setting printhead spacing, such as a sequence of setting spacing 50 of printhead 40.

With sequence 1100, at 1102, setting of a PPS height is initiated. More specifically, setting of a printhead spacing, such as setting of spacing 50 of printhead 40, is initiated. At 1104, a "Home" position of the printhead is established. In one example, the "Home" position includes a "Low" PPS of the printhead. As such, at 1104, the printhead is maintained in the "Low" position or returned to the "Low" position to home the printhead (for example, establish an initial, know position of the printhead).

At 1106, a determination is made as to whether a PPS setting of "Low" is the correct setting. More specifically, a determination is made as to whether the PPS selected for the printhead is "Low" PPS. If the selected PPS is "Low", at 1108, an "OK to Print" is acknowledged since the printhead is already in the "Low" position. More specifically, the current PPS spacing of the printhead is the same as the selected PPS spacing for the printhead.

Returning to 1106, if a PPS setting of "Low" is not the correct setting (for example, a PPS setting of "Medium" or "High" has been selected for the printhead), at 1110, the printhead is lifted to the selected PPS. For example, at 1106, a PPS setting of "Medium" or "High" is established for the printhead.

At 1112, the position of the printhead is held or maintained, and, at 1108, an "OK to Print" is acknowledged since the printhead has been moved to and is held at the selected PPS.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A method of printing, comprising:

directing print media to a print zone between a printhead and a platen for a print job; and adjusting a spacing between the printhead and the platen during the print job, including adjusting the spacing based on an orientation of the print media for the print job.

2. The method of claim 1, wherein adjusting the spacing further comprises adjusting the spacing within a page of the print job, including setting the spacing at a first spacing for an end portion of the print media and setting the spacing at a second spacing for an intermediate portion of the print media, wherein the first spacing is greater than the second spacing.

3. The method of claim 1, wherein adjusting the spacing further comprises adjusting the spacing between pages of the print job, including setting the spacing at a first spacing for a first page of the print job and setting the spacing at a second spacing for a second page of the print job, wherein the second spacing is different than the first spacing.

4. The method of claim 3, wherein the first page of the print job and the second page of the print job include different types of print media.

5. The method of claim 3, wherein the first page of the print job and the second page of the print job include opposite sides of a sheet of the print media.

6. The method of claim 1, wherein adjusting the spacing based on an orientation of the print media includes setting the spacing at a first spacing for a portrait orientation of the print media and setting the spacing at a second spacing for a landscape orientation of the print media, wherein the first spacing is less than the second spacing.

7. A printing system, comprising:

a platen to support a print media; and a printhead to eject ink drops into a print zone between the printhead and the platen and onto the print media, wherein a spacing between the printhead and the platen is adjusted during a print job, including adjustment of the spacing based on an orientation of the print media for the print job.

8. The system of claim 7, wherein adjustment of the spacing further includes adjustment of the spacing within a page of the print job, including a first spacing for an end portion of the print media and a second spacing for an intermediate portion of the print media, wherein the first spacing is greater than the second spacing.

9. The system of claim 7, wherein adjustment of the spacing further includes adjustment of the spacing between pages of the print job, including a first spacing for a first page of the print job and a second spacing for a second page of the print job, wherein the second spacing is different than the first spacing.

10. The system of claim 9, wherein the first page of the print job and the second page of the print job include one of different types of print media and opposite sides of a sheet of the print media.

11. The system of claim 7, wherein adjustment of the spacing based on an orientation of the print media includes a first spacing for a portrait orientation of the print media and a second spacing for a landscape orientation of the print media, wherein the first spacing is less than the second spacing.

12. A method of printing, comprising:

directing print media to a print zone between a printhead and a platen for printing; and adjusting a spacing between the printhead and the platen based on an orientation of the print me dia for the printing.

13. The method of claim 12, wherein adjusting the spacing between the printhead and the platen further includes adjusting the spacing based on environmental conditions of the printing.

14. The method of claim 12, wherein adjusting the spacing between the printhead and the platen further includes adjusting the spacing based on a print mode of the printing.

15. The method of claim 12, wherein adjusting the spacing between the printhead and the platen further includes adjusting the spacing during the printing, including one of adjusting the spacing within printing a page of a print job and adjusting the spacing between printing pages of a print job.

16. The method of claim 12, further comprising:

adjusting the spacing between the printhead and the platen based on a characteristic of the print media including at least one of a type of the print media and a weight of the print media.

17. The method of claim 12, wherein adjusting the spacing based on an orientation of the print media includes a first spacing for advancing the print media in a direction parallel with a longer dimension of the print media and a second spacing for advancing the print media in a direction perpendicular to a longer dimension of the print media, wherein the first spacing is less than the second spacing.

18. The method of claim 12, wherein adjusting the spacing based on an orientation of the print media includes a first spacing for advancing the print media in a direction substantially parallel with a grain of the print media and a second spacing for advancing the print media in a direction substantially perpendicular to a grain of the print media, wherein the first spacing is less than the second spacing.

* * * * *

UNITED STATES PATENT AND TRADEMARK OFFICE

CERTIFICATE OF CORRECTION

PATENT NO. : 8,888,212 B2
APPLICATION NO. : 13/752962
DATED : November 18, 2014
INVENTOR(S) : Mark H. MacKenzie et al.

It is certified that error appears in the above-identified patent and that said Letters Patent is hereby corrected as shown below:

In the Claims

In column 11, line 14, in Claims 12, delete “me dia” and insert -- media --, therefor.

Signed and Sealed this
Twenty-sixth Day of May, 2015

Michelle K. Lee

Michelle K. Lee
*Director of the United States Patent and Trademark Office*